US005682688A

United States Patent [19]

Gallay

[11] Patent Number: 5,682,688

[45] Date of Patent: Nov. 4, 1997

[54] SNOWSHOE HAVING A WIDTH CONSTRICTION IN THE CENTRAL PORTION

[76] Inventor: Philippe Gallay, Le Nojak, 74220 La Clusaz, France

[21] Appl. No.: 613,503

[22] Filed: Mar. 11, 1996

[30] Foreign Application Priority Data

Mar. 10, 1995 [FR] France ..... 95 03088

[51] Int. Cl.[6] ..... A43B 5/04

[52] U.S. Cl. ..... 36/122

[58] Field of Search ..... 36/122, 123, 124, 36/125

[56] References Cited

U.S. PATENT DOCUMENTS

| | | | |
|---|---|---|---|
| 3,555,708 | 1/1971 | Goupil | 36/122 |
| 4,348,822 | 9/1982 | Lesavage | 36/122 |
| 4,446,635 | 5/1984 | Hayden, Jr. | 36/124 X |
| 5,014,450 | 5/1991 | McGrath | 36/122 X |
| 5,553,403 | 9/1996 | McManus | 36/122 X |

FOREIGN PATENT DOCUMENTS

| | | | |
|---|---|---|---|
| 2409066 | 7/1979 | France | 36/124 |

*Primary Examiner*—B. Dayoan
*Attorney, Agent, or Firm*—Louis Weinstein

[57] ABSTRACT

Snowshoe (1) consisting of a perforated plate formed by a peripheral frame (2) including a vertical wall (3) and a screen (4) supporting the attachment designed to hold the user's shoe, the central part (20) being extended toward the front by a front part (21) and toward the rear by a back part (22), wherein at least one of the lateral rims of the frame (2) and/or the screen (4) is concave in the central part (20).

16 Claims, 9 Drawing Sheets

P 4
30a
30b
La 30a
30b
Lb 4
30a
30b
Lc 30a
30b
Ld 4
30a
30b
Le
P

P 40a
40b
La 40a
40b
Lb 40a
40b
Lc 40a
40b
Ld 40a
40b
Le
P

SNOWSHOE HAVING A WIDTH CONSTRICTION IN THE CENTRAL PORTION

FIELD OF THE INVENTION

The present invention concerns a snowshoe and more particularly an improvement increasing its performance and comfort.

BACKGROUND OF THE INVENTION

Snowshoes are devices known for very many years because they have been used for several centuries by the Scandinavian populations to move about on the snow. Up to the present, snowshoes have been used for practical or military purposes to permit populations and alpine troops to travel on the snow for movements required by their everyday life. Currently, snowshoes are rather used by athletes who take excursions and outings, even engage in competitions. But athletes, even though they are acting for pleasure, are more and more demanding in the material which they use, and it is true that the products currently sold do not provide complete satisfaction, particularly during advancing on difficult snow.

OBJECT OF THE INVENTION

The present invention proposes a new snowshoe combining at one and the same time good performance in adhesion and support on the snow, while permitting an easy advance in ascents as well as in descents, as well as in crossings.

BRIEF DESCRIPTION OF THE INVENTION

Thus, according to the invention, the snowshoe, consists of a perforated plate formed by a peripheral frame including a vertical wall and a screen supporting the attachment designed to hold the user's shoe, while central part is extended toward the front by a front part and toward the back by a back part, and is characterized by the width between the lateral edges of the frame and/or the screen presenting a constriction in width in the central part in relation to the front and back part so a width "Lc" at the level of the constriction is less than a width "La" of the front part and a width "Le" of the back part.

According to another characteristic at least one of the lateral rims of the frame and/or the screen is concave in the central part occupied by the shoe.

In one of the possible embodiments of the invention, the two lateral, peripheral walls of the frame have a concave form on both sides while, in another embodiment, the two lateral rims of the screen have a concave form on both sides.

Note that, advantageously, the central part corresponds to the zone occupied by the shoe.

According to an additional characteristic the minimal constriction in length, that is to say where the frame and/or the screen is/are most narrow is advantageously located in the central part occupied by the shoe.

BRIEF DESCRIPTION OF THE FIGURES

Other characteristics and advantages of the invention will emerge in the following with respect to the appended drawings which are only provided as non-restricting examples.

FIGS. 1 to 2 are illustrations showing the snowshoe according to the first form of construction with an attachment, which attachment is provided in the capacity of an example.

FIG. 1 is seen from above, but without the shoe.

FIG. 2 is a side view, the shoe being represented by thin dotted lines.

FIGS. 3 and 4 are views similar to FIGS. 1 and 2, but without the attachment and in another scale.

FIG. 5 is a view of FIG. 3 from below.

FIG. 6 is a view in longitudinal section along 6—6 of FIG. 5.

FIGS. *7a*, *7b*, *7c*, *7d*, *7e* are views in section along *7a—7a*, *7b—7b*, *7c—7c*, *7d—7d*, *7e—7e*, showing the variations in the width of the frame.

Figure 6:
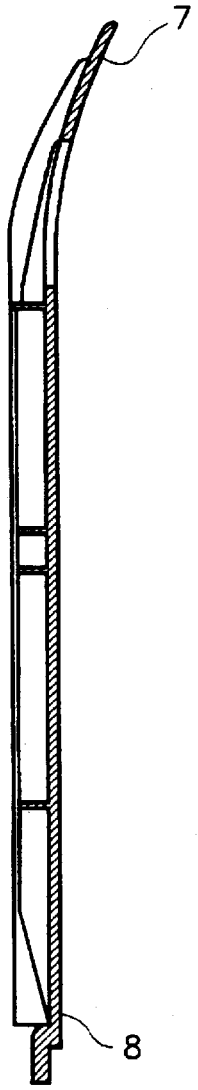
Figure 5:
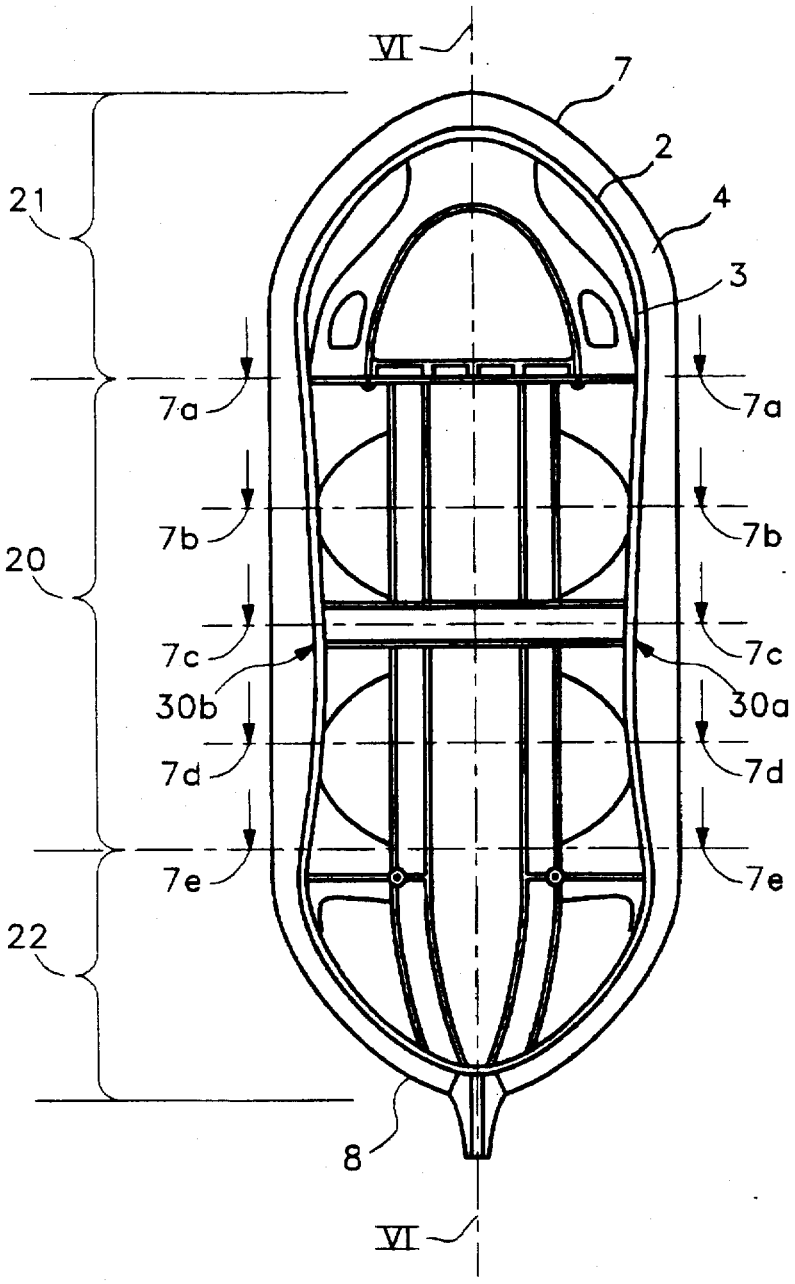
Figures 7A, 7B, 7C, 7D, 7E:
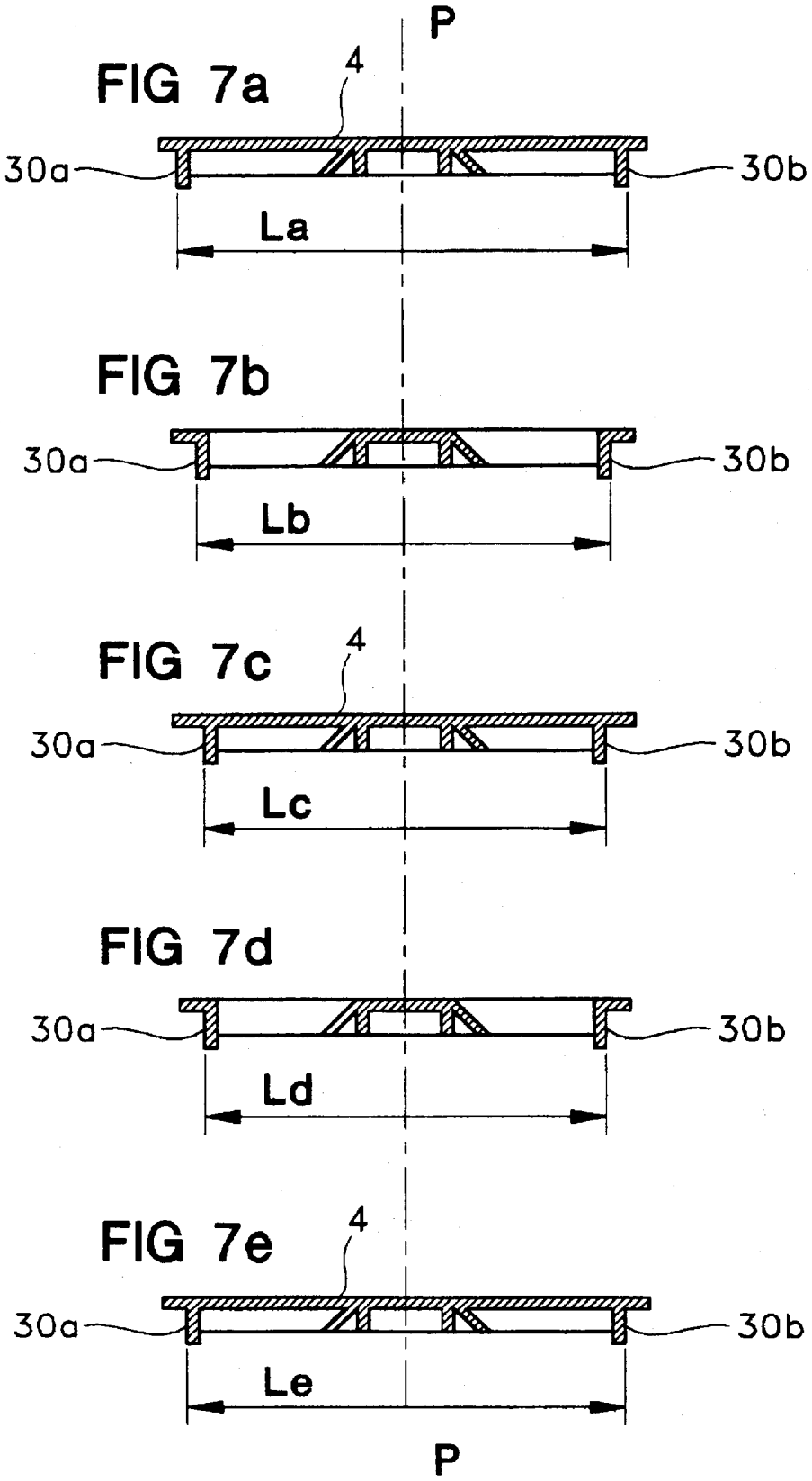

FIGS. 8, 9, 10*a*, 10*b*, 10*c*, 10*d*, 10*e* are views similar to FIGS. 5, 6 and *7a*, *7b*, *7c*, *7d*, *7e*.

Figure 11:
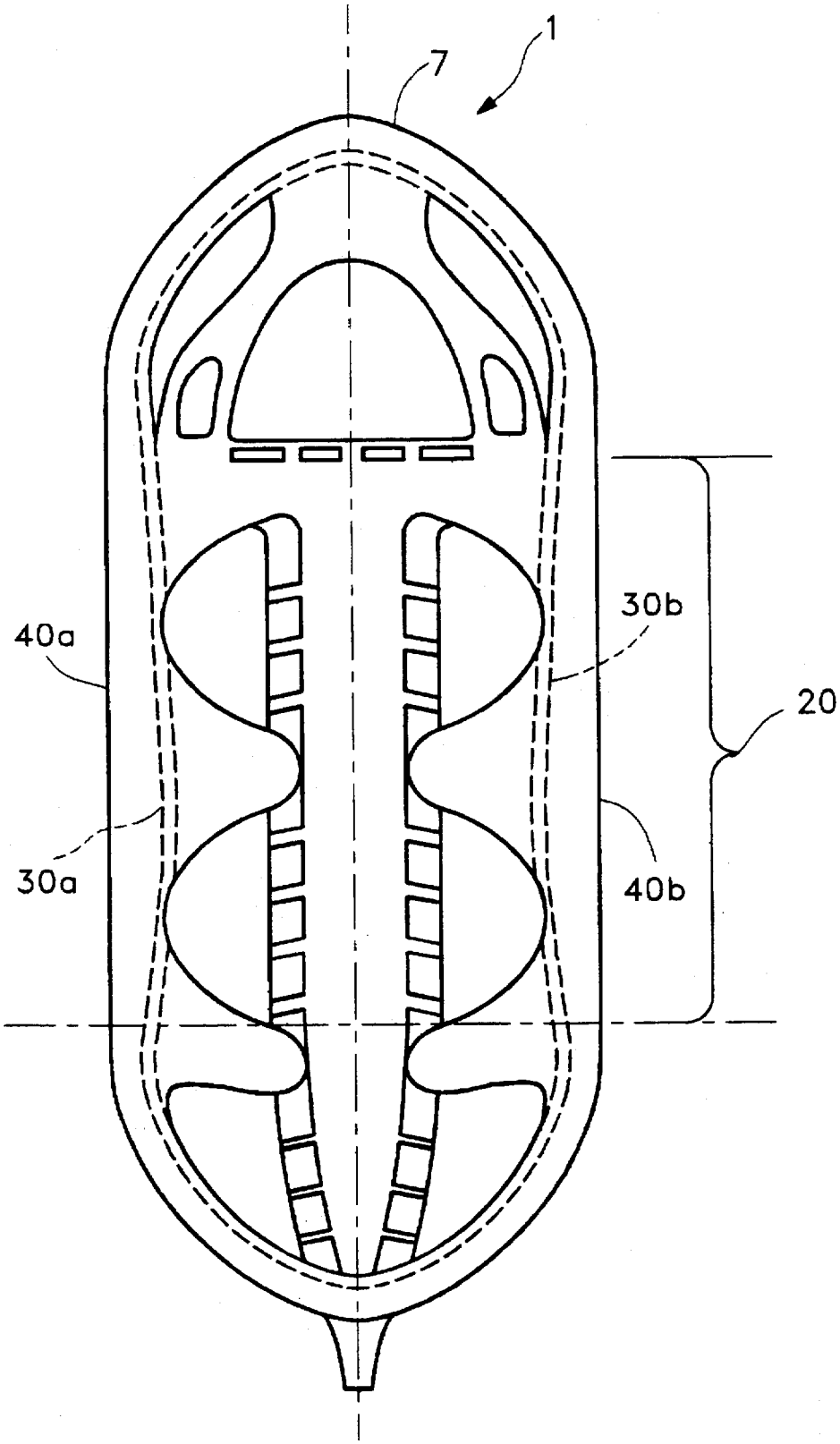

FIG. 11 is a view of an other construction variant from above.

Figure 12:
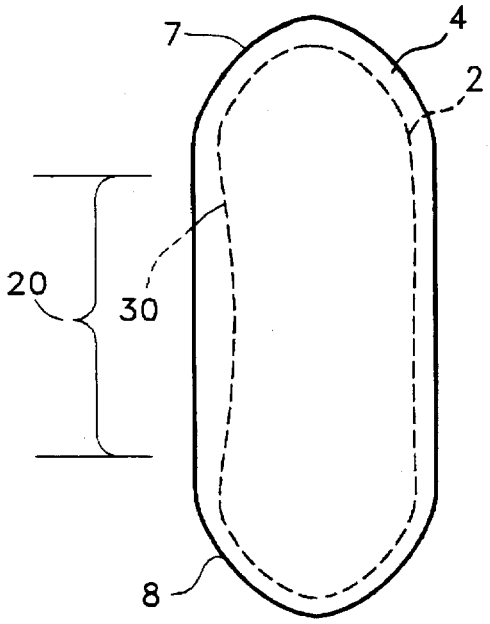
Figure 13:
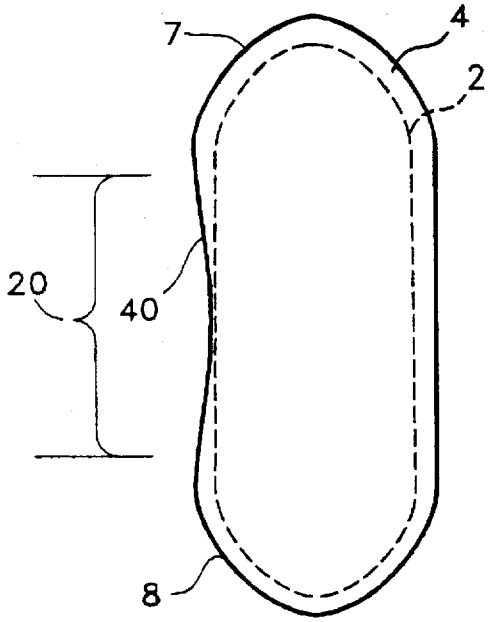
Figure 14:
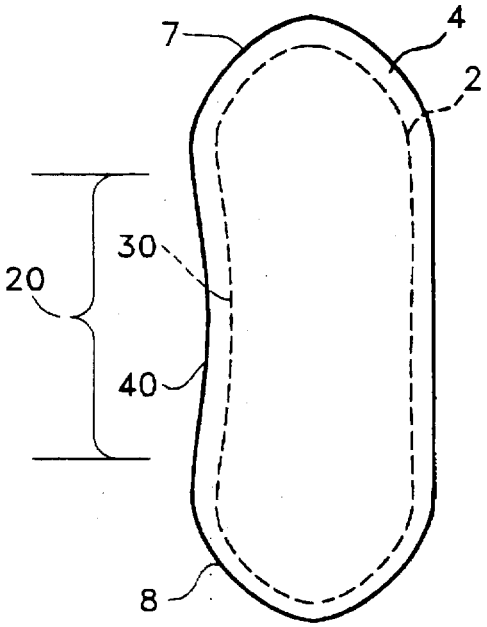

FIGS. 12, 13 and 14 are schematic views from above of three embodiment variants.

Figure 15:
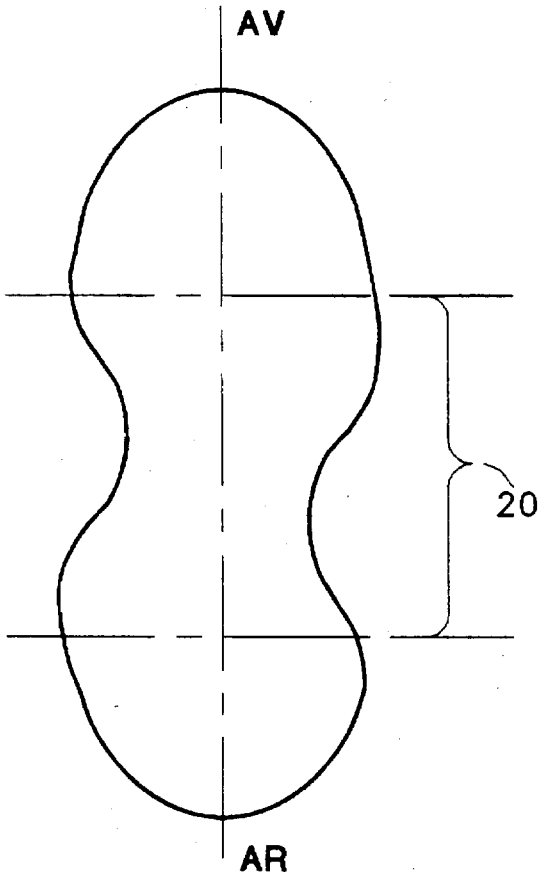
Figure 16:
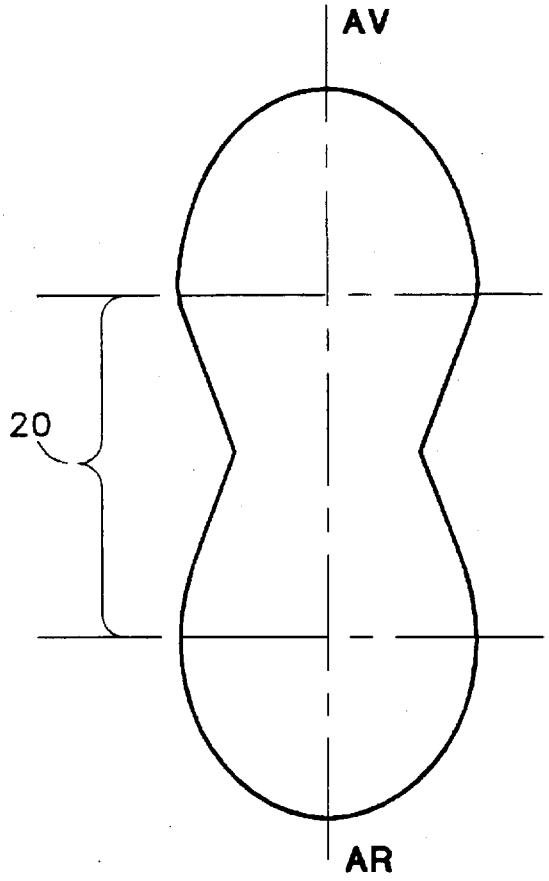

FIGS. 15 and 16 are also two other embodiment variants.

DETAILED DESCRIPTION OF THE INVENTION AND PREFERRED EMBODIMENTS THEREOF

The snowshoe designated under the general reference (1) presents itself in the form of a perforated plate of general symmetrical plan (P) fastened under the shoe which is comprised by a principal frame (2) and a screen (4) including a complement of walls supporting the attachment (5) designed to retain the user's shoe (6).

The aforesaid screen (4) with its complement of internal walls forms a general lower support surface on the snow permitting the user not to penetrate too much into the snow, and this thanks to the relatively significant carrying surface. Note that the attachment (5) designed to hold the shoe (6) is, according to the illustration given by way of example, articulated in relation to the screen (4) of the snowshoe proper along a transverse axis (XX'). In an advantageous manner, the aforesaid attachment bearing the general reference (5) consists of an articulated plate (9) including means of retention for the shoe, specifically the front facility (10) and the back facility (11). In this manner, the forward extremity (12) of the shoe is, for example, retained by a front stirrup (13), while its rear extremity is held thanks to a pivoting rear stirrup (15), including a retaining lever (16). The plate (9) is advantageously rigid and extends longitudinally, including an upper support surface (17) to support the sole of the shoe. Of course, the snowshoe of the invention can be equipped with any other type of shoe attachment device as, for example, that described in the French patent application No. 94 05919 by the applicant.

The snowshoe (1) includes a central part (20) extended on the one hand toward the front (AV) by a slightly raised front part (21) constituting the snowshoe tip (7), and on the other hand, toward the rear (AR) by a back zone (22), constituting the heel (8). In another connection, the frame (2) consists of a peripheral wall (3) perpendicular to the general horizontal plane (H) of the screen (4). We add that the central part (20) is laterally 10 bounded on each side by the lateral rim, on the one hand by the frame (2, 3), on the other by the screen (4). In this manner, the central part (20) of the snowshoe (1) is bounded on the left side (GA) by the left lateral wall (30*a*) of the frame (2), and by the left lateral edge (40*a*) of the screen, while the right side (DR) is bounded by the right lateral wall (30*b*) of the frame (2) and by the right lateral rim (40*b*) of the screen. Note that the central part (20) is bounded in front by the forward transverse plane (P1) separating it from the front part (21), while it is bounded to the rear by the rear transverse plane (P2).

According to the invention, the lateral wall (30*a*, 30*b*) of the frame (2) and/or the lateral rim (40*a*, 40*b*) of the screen (4) presents a concave curve on the horizontal plane in the central part (20) of the shoe, that is, in order to have a reduced width in this central part in relation to the width in front and back parts.

FIGS. 1 to 7 represent a first form of construction according to which it is the peripheral walls (3) of the frame (4) which present a concave profile in the central part to form a narrowing in the width dimension ("L") at the level of the zone occupied by the shoe. In this construction, the width "L" between the two lateral walls (30*a*, 30*b*) diminishes in a progressive fashion towards the rear from the front plane (P1) on up to the middle plane (P3) corresponding to the most narrow region, subsequently to increase progressively toward the rear up to the rear plane (P2). Note that the two lateral walls (30*a*, 30*b*) of the frame have a curved concave configuration along an arc of a circle of radius R, the center of the circle being in a region exterior to the snowshoe (1). FIGS. 7*a*, 7*b*, 7*c*, 7*d*, 7*e* illustrate the progressive variation of the width "L" between the two lateral walls (30*a*, 30*b*) along various successive sections. One thus establishes that in section 7*a*—7*a*, the width "La" is greater than width "Lb" measured in section 7*b*—7*b*, and the width "Lc" at the center along section 7*c*—7*c* is less than widths "La" and "Lb." By the same token, in section 7*e*—7*e*, the width "Le" is greater than width "Ld" measured in section 7*d*—7*d*, and width "Lc" in the center along the section 7*c*—7*c* is smaller that the widths "Le" and "Ld." One confirms with such a construction of the frame that the peripheral walls of the frame which assist in adhesion during movement are near the foot in the foot zone and gradually separate from the plane (P) toward the front and toward the back so that support on the snow is sufficiently broad in the front and back part of the snow shoe.

Figure 8:
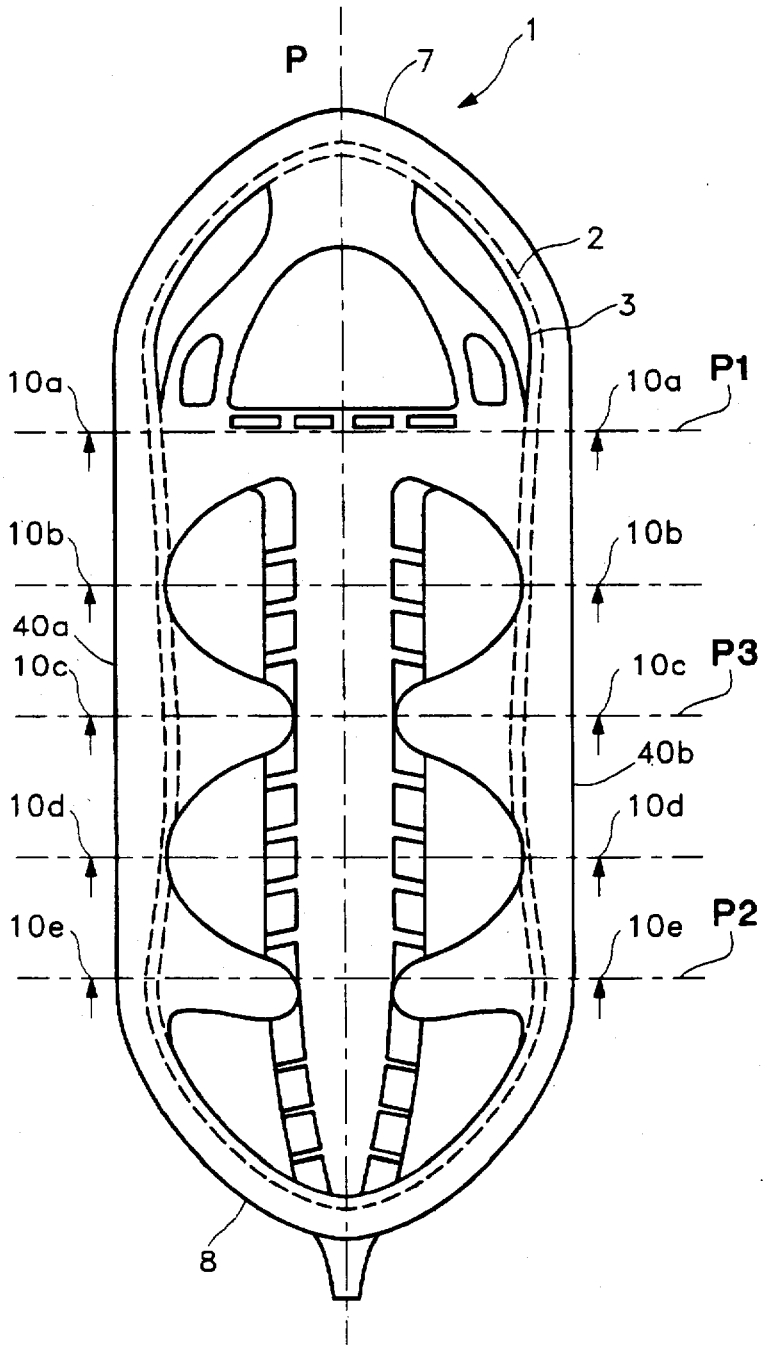
Figure 9:
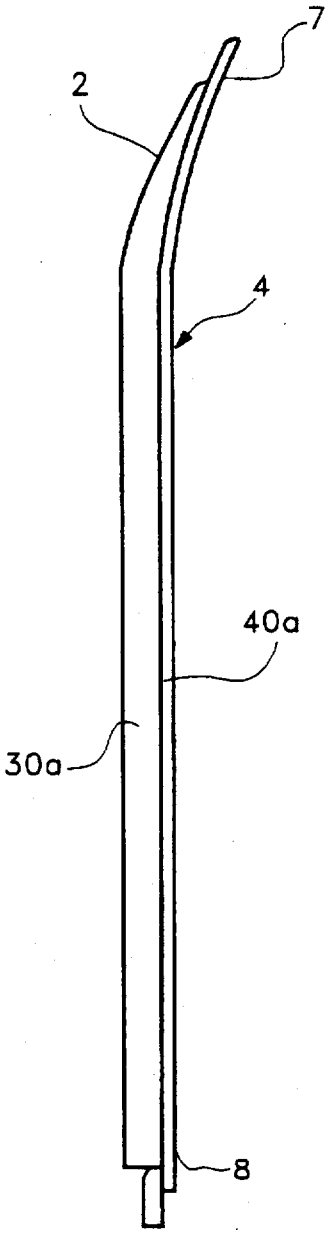
Figures 10A, 10B, 10C, 10D, 10E:
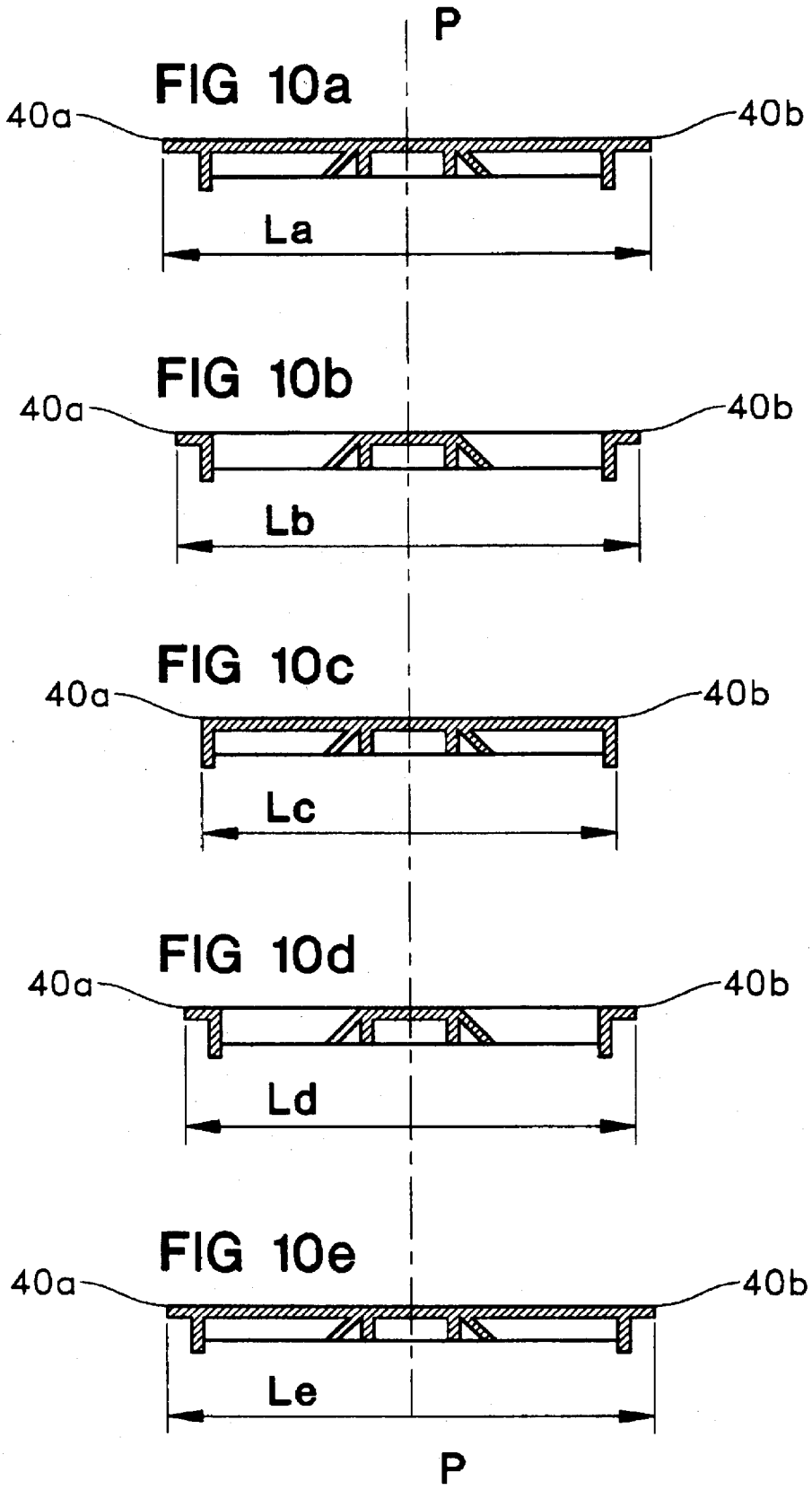

It stands to reason that one would not depart from the framework of the invention if only the screen (4) were such that its width in front and back were greater than its breadth in the center, as is illustrated by FIGS. 8, 9 and 10. In this manner, in this construction, it is the lateral rims (40*a*, 40*b*) of the screen (4) which present a concave profile in the central part to form a constriction in width at the level of the zone occupied by the shoe. In this construction, the width "L" between the two lateral rims (40*a*, 40*b*) progressively diminishes toward the rear beginning with the plane P1 up to the middle plane P3 corresponding to the most narrow zone, subsequently to increase gradually toward the rear up to the plane P2. Note that the two lateral rims (40*a*, 40*b*) of the frame have a curved concave configuration along an arc of a circle with radius R, the center of the circle being a zone outside the snowshoe (1). FIGS. 10*a*, 10*b*, 10*c*, 10*d*, 10*e* illustrate the progressive variation of the width "L" along different successive sections between the two lateral rims (40*a*, 40*b*). In this manner, one confirms that in the section 10*a*—10*a*, the width "La" is greater than the width "Lb" measured on the section 10*b*—10*b*, and that the breadth "Lc" at the center along section 10*c*—10*c* is smaller that widths "La" and "Lb." Likewise, in section 10*e*—10*e*, width "Le" is greater than width "Ld" measured on section 10*d*—10*d*, and the width "Lc" at the center along section 10*c*—10*c* is smaller than breadths "Le" and "Ld."

FIG. 11 is a view from above representing another form of construction according to which the curves of the lateral walls (30a, 30b) of the frame of the construction of FIGS. 1 to 7 is associated with (i.e. conforms with) the curves of the lateral rims (40*a*, 40*b*) of the screen.

Figure 1:
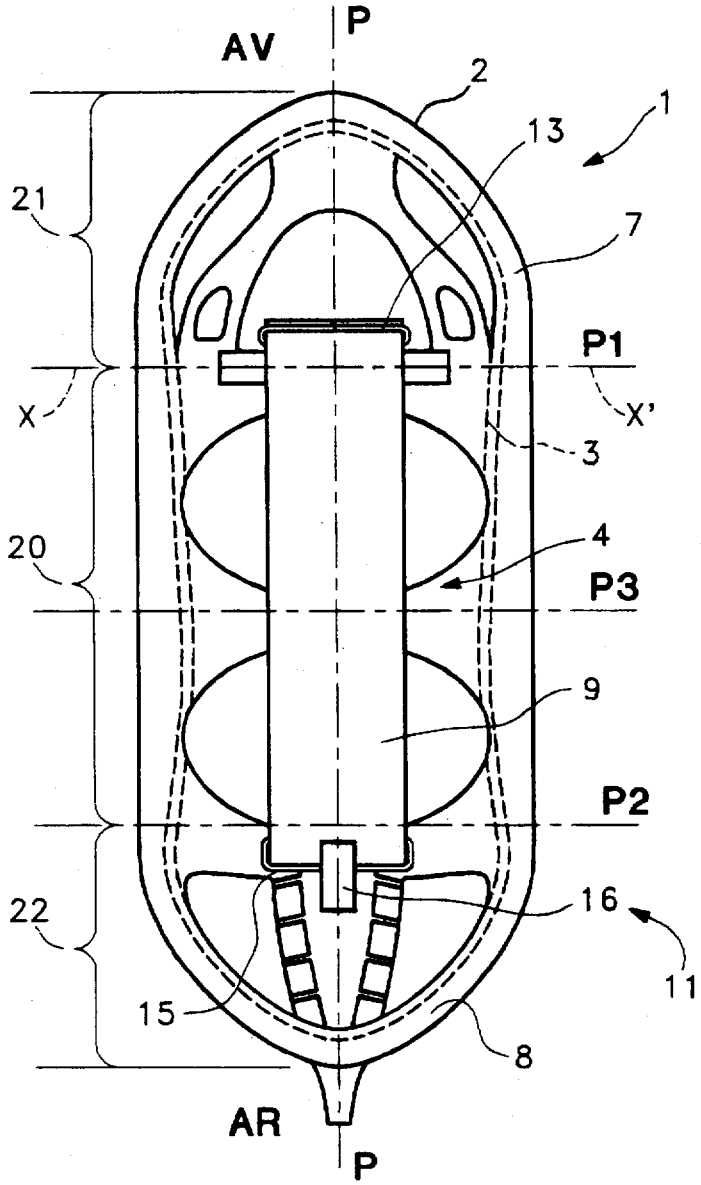
FIGS. 1 to 7 illustrate a first form of construction given under the rubric of an example.
Figure 2:
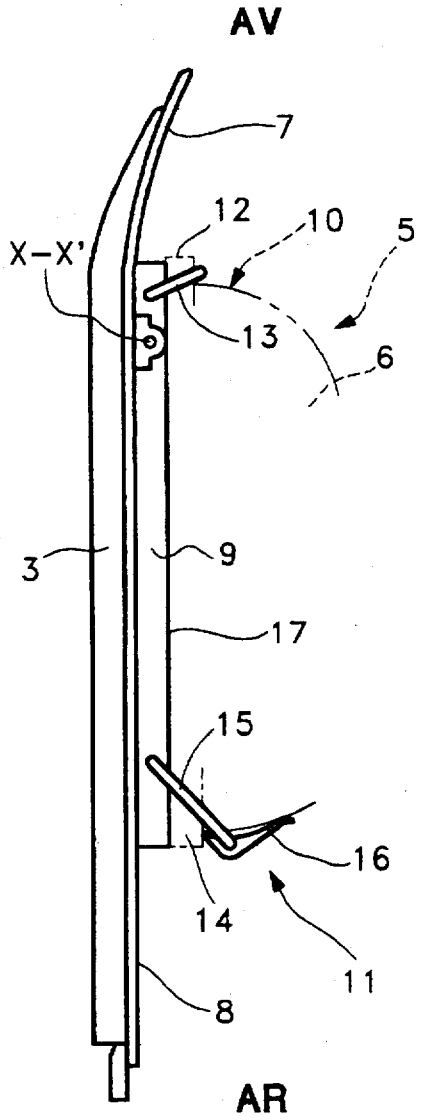
Figure 3:
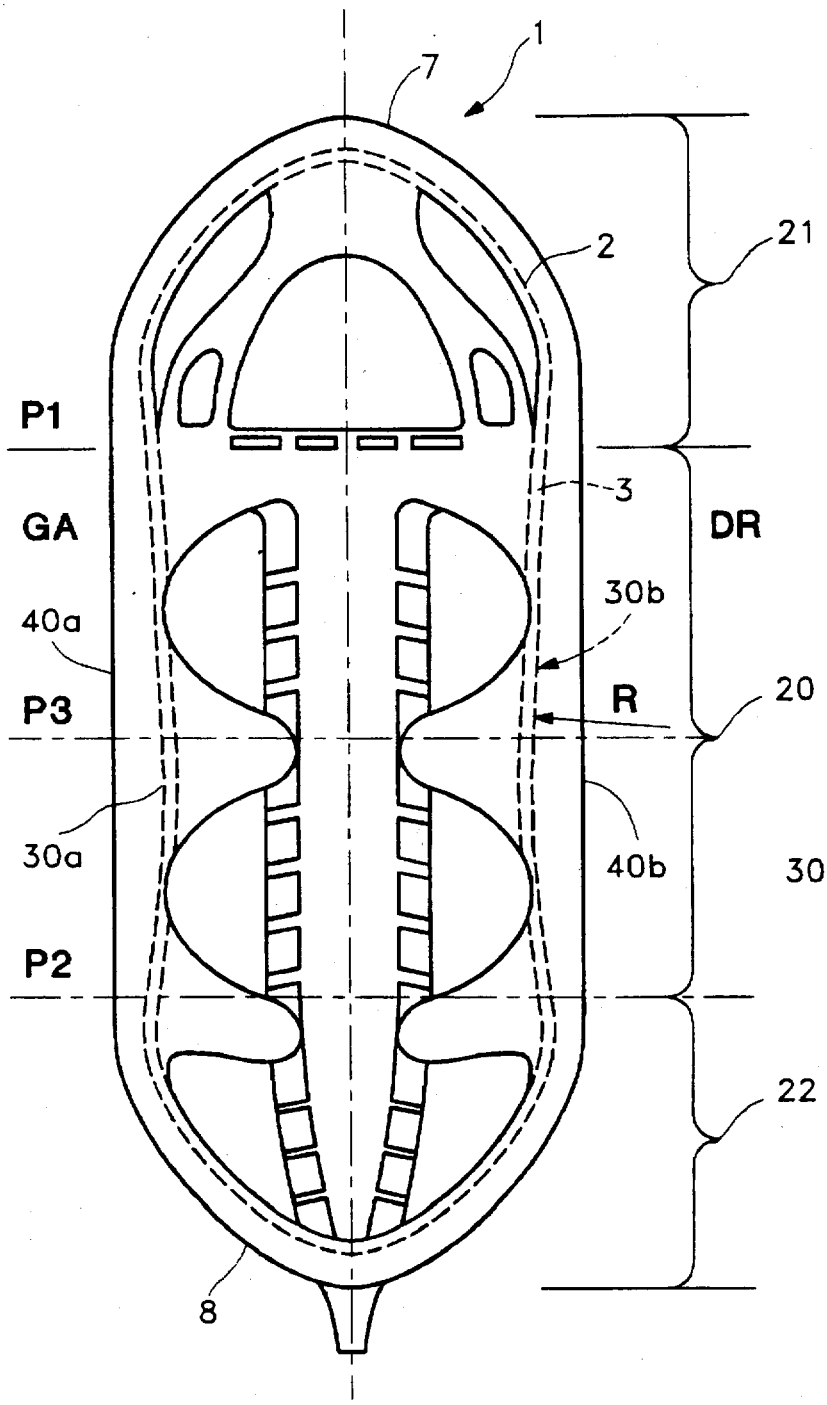
Figure 4:
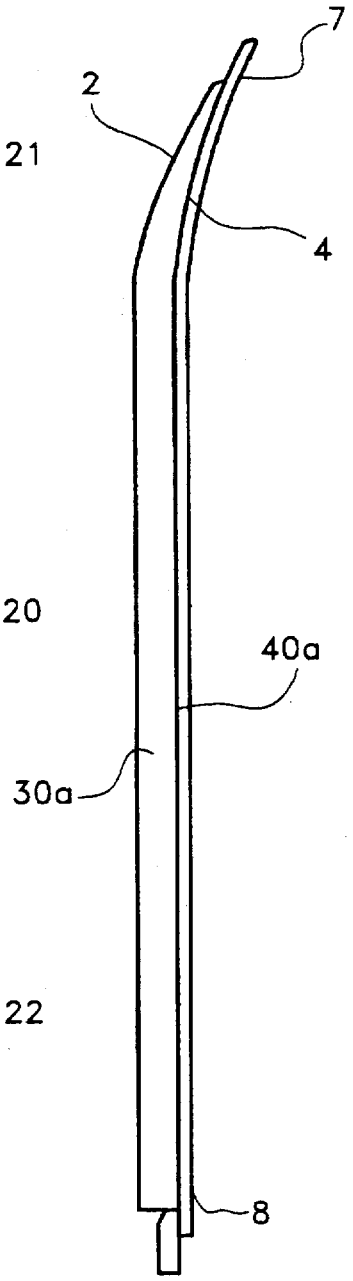

It stands to reason that the snowshoe could be asymmetrical as is illustrated in FIGS. 12, 13 and 14, which illustrate three other forms of embodiment of the construction of FIGS. 3, 8 and 11 where only the lateral border of one of the left or right sides is concave.

FIGS. 15 and 16 illustrate other possible forms of embodiment in schematic fashion. According to the variant of FIG. 15, the left and right concave curves are not symmetrical in relation to plane P. Another manner of providing the concave form for the rims, which are constructed by rectilinear segments in place of a curved form, is illustrated according to the variants of FIG. 16.

One will note that the central part (20) of the snowshoe advantageously corresponds to the zone occupied by the attachment and the user's shoe.

Moreover, we add that maximum constriction in width, that is, where the frame and/or the screen is/are most narrow is advantageously located in the central part occupied by the shoe as clearly appears in the drawings.

Of course, the invention is not restricted to the forms of construction described and represented in the capacity of examples, but it also includes all technical equivalents as well as their combinations.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. Snowshoe (1) consisting of a perforated plate formed by a peripheral frame (2) including a downwardly extending vertical wall along a periphery of the perforated plate (3) and a screen (4) having said perforations and supporting an attachment (5) provided to hold a user's shoe (6), a central part (20) being extended toward the front by a front part (21) and toward the rear by a rear part (22), wherein a width between lateral rims (30, 40) of one of the frame (2) and the screen (4) presents a constriction in width ("L") in the central part (20) in relation to the front part and the back part.

2. Snowshoe according to claim 1, wherein a width ("Lc") at a center of the constriction in width ("L") is smaller than a width ("La") of the front part (21) and than a width ("Le") of the back part (22).

3. Snowshoe according to claim 2, wherein in the central part (20), a width between the lateral rims (30,40) of one of the frame (2) and the screen (4) progressively varies from the front toward the rear to diminish from the front part (21) and afterwards to increase in proportion as one approaches the rear part (22).

4. Snowshoe according to claim 1, wherein at least one of the lateral rims (30, 40) of one of the frame (2) and the screen (4) is concave in a central part (20) provided for receiving a shoe.

5. Snowshoe according to claim 4, wherein two peripheral lateral walls (30*a*, 30*b*) of the frame (2) present a concave form on both sides.

6. Snowshoe according to claim 4 or claim 5, wherein the two lateral rims (40*a*, 40*b*) of the screen (4) present a concave form on both sides.

7. A snowshoe according to claim 1, wherein the central part (20) corresponds to that provided for receiving a shoe.

8. A snowshoe according to claim 1, wherein a maximum constriction in width, that is, where the one of the frame and the screen is (are) most narrow is advantageously located in the central part provided for receiving a shoe.

9. Snowshoe (1) consisting of a perforated plate formed by a peripheral frame (2) including a downwardly extending vertical wall (3) along a periphery of the perforated plate and a screen (4) having said perforations and supporting an attachment (5) provided to hold a user's shoe (6), a central part (20) being extended toward the front by a front part (21) and toward the rear by a rear part (22), wherein a width between lateral rims (30) of the frame (2) and a width between lateral rims (40) of the screen (4) present a constriction in width ("L") in the central part (20) in relation to the front part and the back part.

10. Snowshoe according to claim 9, wherein a width ("Lc") at a center of the constriction in width ("L") is smaller than a width ("La") of the front part (21) and than a width ("Le") of the back part (22) for both of the frame (2) and the screen (4).

11. Snowshoe according to claim 10, wherein in the central part (20), a width between the lateral rims (30) of the frame (2) and a width between lateral rims (40) of the screen (4) progressively vary from the front toward the rear to diminish from the front part (21) and afterwards to increase in proportion as one approaches the rear part (22).

12. Snowshoe according to claim 9, wherein at least one of the lateral rims (30) of the frame (2) and one of the lateral rims (40) of the screen (4) are concave in a central part (20) provided to receive a shoe.

13. Snowshoe according to claim 12, wherein two peripheral lateral walls (30*a*, 30*b*) of the frame (2) present a concave form on both sides.

14. Snowshoe according to claim 12, or claim 5, wherein the two lateral rims (40*a*, 40*b*) of the screen (4) present a concave form on both sides.

15. A snowshoe according to claim 9, wherein the central part (20) corresponds to that provided for receiving a shoe.

16. A snowshoe according to claim 9, wherein a maximum constriction in width, that is, where the frame and the screen are most narrow is advantageously located in the central part provided for receiving a shoe.

* * * * *